US005654608A

United States Patent [19]

Westemeyer et al.

[11] Patent Number: 5,654,608

[45] Date of Patent: Aug. 5, 1997

[54] CAPPED ELECTRIC LAMP

[75] Inventors: Manfred Westemeyer, Aldenhoven; Hans J. Kohl; Ralf Schäfer, both of Aachen, all of Germany

[73] Assignee: U.S. Philips Corporation, New York, N.Y.

[21] Appl. No.: 577,684

[22] Filed: Dec. 21, 1995

[30] Foreign Application Priority Data

Dec. 23, 1994 [EP] European Pat. Off. ..... 94203750

[51] Int. Cl.[6] ..... H01J 61/30; H01K 1/18; F21M 3/14

[52] U.S. Cl. ..... 313/634; 313/318.01; 313/318.05; 313/623; 362/255; 439/611

[58] Field of Search ..... 313/318.01, 318.03, 313/318.05, 318.06, 318.07, 318.08, 634, 623, 110, 17; 362/255, 256; 439/232, 611, 612, 617, 618, 619

[56] References Cited

U.S. PATENT DOCUMENTS

| | | | |
|---|---|---|---|
| 5,216,319 | 6/1993 | Van Heeswijk | 313/318 |
| 5,320,562 | 6/1994 | Moller et al. | 439/613 |
| 5,378,958 | 1/1995 | Van Heeswijk | 313/318 |

FOREIGN PATENT DOCUMENTS

| | | | |
|---|---|---|---|
| 0559281 | 9/1993 | European Pat. Off. | H01J 5/56 |
| 0559281A1 | 9/1993 | European Pat. Off. | H01J 5/56 |
| 0570068 | 11/1993 | European Pat. Off. | H01J 61/34 |
| 0570068A1 | 11/1993 | European Pat. Off. | H01J 61/34 |
| 0579313A1 | 1/1994 | European Pat. Off. | H01K 1/00 |
| 0579313 | 1/1994 | European Pat. Off. | H01K 1/00 |
| 0579326 | 1/1994 | European Pat. Off. | H01J 5/56 |
| 0579326A1 | 1/1994 | European Pat. Off. | H01J 5/56 |
| 0581354 | 2/1994 | European Pat. Off. | H01J 61/36 |
| 0581354A1 | 2/1994 | European Pat. Off. | H01J 61/36 |
| 9532516 | 11/1995 | WIPO | H01J 5/50 |

*Primary Examiner*—Sandra L. O'Shea
*Assistant Examiner*—Joseph Williams
*Attorney, Agent, or Firm*—Walter M. Egbert, III

[57] ABSTRACT

The capped electric lamp has a glass lamp vessel (1) having first and second neck-shaped portions (2,3). An outer glass envelope (8) has a narrowed portion (9) where it is coupled to the first neck-shaped portion (2). A metal sleeve (10) has a clamping zone (11) which clampingly holds the outer envelope (8), and a welding zone (12) to which tongues (21) of a fixation member (20) which is fixed in a lamp cap (30) are welded. The metal sleeve (10) becomes narrower from the clamping zone (11) towards the first neck-shaped portion (2) up to the welding zone (12).

11 Claims, 3 Drawing Sheets

CAPPED ELECTRIC LAMP

The invention relates to a capped electric lamp comprising:

- a glass lamp vessel with a first and a second neck-shaped portion in mutual opposition with seals through which respective current supply conductors are passed to an electric element arranged in the lamp vessel;
- around the lamp vessel, a glass outer envelope which has a narrowed portion where the outer envelope is coupled to the first neck-shaped portion of the lamp vessel;
- a metal sleeve which clamps around the outer envelope and which has a clamping zone and a welding zone which lies clear of glass surrounded by said welding zone;
- a metal fixation member provided with tongues which are welded to the sleeve in the welding zone thereof;
- a lamp cap of insulating material connected to the lamp vessel, in which lamp cap the fixation member is fixed and which lamp cap has contact members to which the current supply conductors are connected.

Such a capped electric lamp is known from U.S. Pat. No. 5,320,562. The lamp may be used as a vehicle headlamp, especially when the electric element is a pair of electrodes.

In the known lamp, the metal sleeve grips around the outer envelope in a location which lies at the other side of the narrowed portion in this envelope than does the electric element. The fixation member is welded to the sleeve after the electric element has been brought into a predetermined position relative to reference points at the lamp cap through shifting, rotating and/or tilting of the lamp vessel.

A metal sleeve around the envelope in the cited Patent document forms an alternative for the construction in which the sleeve bears directly on the first neck-shaped portion. This construction may be used in a lamp having an outer envelope, such as that known from, for example, EP-A 0 570 068 (PHN 14.063), EP-A 0 581 354 (PHN 14.128), and EP-A 0,412,275, as well as in a lamp without an outer envelope. The latter lamp type is also known from, for example, U.S. Pat. No. 5,216,319, U.S. Pat. No. 5,378,958, and EP-A 0 579 313 (PHN 14.133).

It is disadvantageous to provide a lamp having an outer envelope with a sleeve which bears directly on the first neck-shaped portion. The fastening of the outer envelope to said neck-shaped portion has in fact weakened this portion mechanically. This involves the risk that this portion breaking off under the influence of, for example, a shock. In the lamp of Patent Application EP 94 201 416.8 (PHN 14.863) of older date, this disadvantage is avoided in that a pinch is provided in the outer envelope adjoining the narrowed portion therein, a clamping member by which the lamp cap holds the lamp vessel bearing on said pinch.

It is a disadvantage of a lamp having a pinch in the outer envelope, and also of a lamp as mentioned in the opening paragraph where the lamp vessel is held by a sleeve around the outer envelope, that the clamping member or metal sleeve has comparatively great lateral dimensions compared with a sleeve which bears directly on the first neck-shaped portion. The fixation member must have correspondingly large lateral dimensions. It is difficult to accommodate such a comparatively large fixation member in the standard lamp cap of the known lamp and still retain sufficient space within the fixation member for moving the clamping member or sleeve in order to align the lamp vessel.

It is an object of the invention to provide a capped electric lamp of the kind described in the opening paragraph which is of a reliable and simple construction which is easy to realise.

According to the invention, this object is achieved in that the sleeve tapers away from the clamping zone around the outer envelope towards the first neck-shaped portion up to the welding zone.

In the known lamp, the welding zone of the sleeve is wider than the clamping zone, so that the welding zone clears the glass surrounded by this zone. It is achieved thereby that the enclosed glass is not thermally loaded locally while welded joints with the fixation member are being made. The creation of stresses in the glass is counteracted thereby.

In the lamp according to the invention, however, a sleeve is used which becomes narrower from the clamping zone up to the welding zone, towards the neck-shaped portion. The sleeve accordingly extends over the relevant end of the outer envelope. The welding zone in the lamp according to the invention has smaller lateral than the clamping zone. The sleeve may taper towards the neck-shaped portion to such an extent that the welding zone just clears the glass thereof. The fixation member may thus have dimensions similar to those of the fixation member of a known lamp which has no outer envelope, as known from the cited U.S. Pat. No. 5,216,319, EP-A 0 559 281 (PHN 14.010), and EP-A 0 569 313 (PHN 14.133).

It is favourable when the clamping zone extends between the narrowed portion of the outer envelope and the electric element. The outer envelope may then have its relevant end adjacent said narrowed portion. An advantage thereof is that the distance from the lamp cap to the electric element may be chosen to be comparatively short, as desired.

The sleeve may be built up from a first part comprising the clamping zone and a second part comprising the welding zone. The narrowing portion of the sleeve may be integral with the first or, which is convenient, with the second part. A sleeve made of one piece, however, is advantageous. An additional assembly step is thus avoided.

The sleeve may be bent from metal plating, for example steel plating such as spring steel. The sleeve may have the geometry of the sleeve of the lamp known from the cited U.S. Pat. No. 5,320,562 in the clamping zone, with at least one pair of mutually opposed tags which are welded together and which close the clamping zone, and with at least one loop in the shape of an open hairpin for accommodating differences in thermal expansion between the glass and the metal of the sleeve. A favourable sleeve is one having two pairs of welding tags and, for example between these pairs, a pair of closing tags in mutual opposition at some distance from one another to which a tool can be applied during welding for pulling the welding tags of a pair against one another.

It is favourable when the sleeve is substantially cylindrical in the welding zone. The lamp vessel may then be rotated together with the sleeve during alignment, if so desired, before being coupled to the fixation member. A set of pairs of mutually opposed welding tags may be present at the welding zone to lend it an additional stiffness, the welding tags of a pair being fastened to one another by welding.

In another embodiment, the sleeve is tubular with an angled cross-section in the clamping zone. A favourable cross-section is a quadrangular, in particular a square cross-section in the clamping zone because of the slimness of the sleeve and also its stiffness. Alternatively, however, the clamping zone may be polygonal. It is also favourable when the welding zone is cylindrical in view of the possibility of rotating the lamp vessel with the sleeve during alignment. This sleeve has the advantage that it need not be closed by means of welds after its application. The sleeve may be closed prior to its application, for example by welding, or it may be tubular from the start, for example because it was formed from plating by deep-drawing. Before being mounted, the sleeve has an undersize compared with the outer envelope in its clamping zone. When the sleeve is passed over the outer envelope, a deformation occurs whereby the sides of the triangle, quadrangle, or polygon are bent outwards where they are in contact with the glass, as seen in cross-section. The sleeve thus holds the outer envelope securely and is also capable of adapting itself elastically to differences in thermal expansion.

The sleeve may be so positioned that it has no or substantially no influence on the radiated light. This is important in applications where the substantially free issuing of light is desirable. In that case, the sleeve extends over the outer envelope at most up to a location which encloses an angle $\alpha$ of 55° with the perpendicular to the outer envelope, the vertex of angle $\alpha$ lying in the centre of the electric element.

In a special embodiment, however, the clamping zone of the sleeve extends at least from a location enclosing an angle $\alpha$ of 50° with the perpendicular to the outer envelope, the vertex of angle $\alpha$ lying in the centre of the electric element. The angle $\alpha$ may alternatively be a few degrees smaller, for example 45° or 40°, without the luminous flux in the beam of a lantern in which the lamp is used being substantially reduced thereby. This embodiment has the advantage that the creation of parasitic radiation is counteracted when the lamp is used in a vehicle headlight where such parasitic radiation would otherwise occur. It is avoided then that a light-absorbing band is to be applied on the outer envelope for this purpose, as described in Patent Application EP 94 201 318.6 (PHN 14.852) of earlier date.

In a special embodiment, tongues extend along the electric element on either side of that electric element away from the sleeve. When the lamp according to the invention is used in a headlight for forming a passing beam, said tongues contribute to a sharp light/dark cut-off in the beam. As a result, the beam may be aimed comparatively high, so that the headlight shines comparatively far. It is nevertheless avoided that leading or approaching traffic is dazzled. If the lamp is designed for forming an asymmetrical light beam, whereby that side of the road along which the traffic moves is illuminated over a greater distance than the central reservation or the other side of the road, it is useful when edges of the tongues facing away from one another enclose an angle $\beta$ of substantially 165° with one another. The vertex here lies in the centre of the electric element. Mutually facing edges of the tongues may then enclose an angle $\gamma$ of 85° to 145° with one another, the vertex again lying in the centre of the electric element. Such tongues do not substantially influence the lamp thermally. If so desired, the tongues may be interconnected at a distance from the clamping zone, for example adjacent their free ends, so that they define a light window.

Embodiments of the capped lamp according to the invention are shown in the drawing, in which FIG. 1 shows an embodiment of the lamp in side elevation, with a diagrammatically indicated sleeve;

Figure 1:
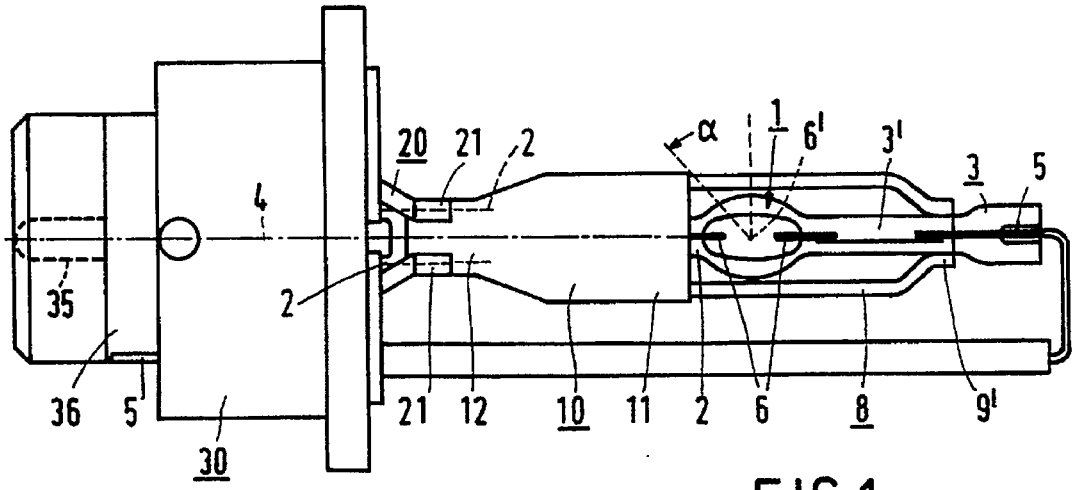
Figure 2:
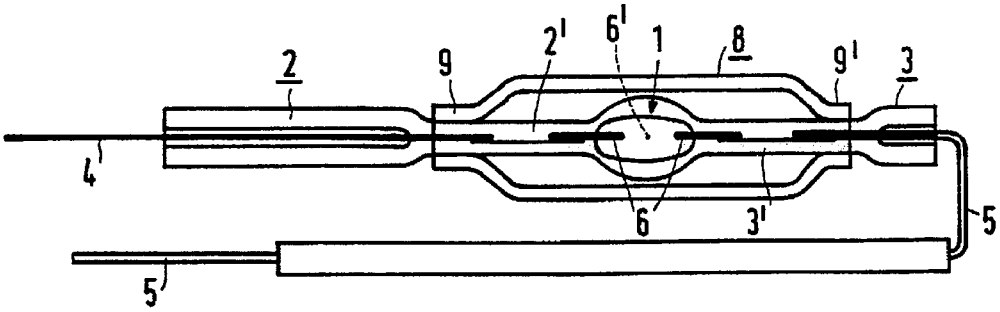
FIG. 2 shows the lamp vessel of FIG. 1 before the sleeve is provided.

In FIGS. 1 and 2, the capped electric lamp has a glass lamp vessel 1, made of quartz glass in the Figures, with a first 2 and a second neck-shaped portion 3 in mutual opposition with seals 2', 3' through which respective current supply conductors 4, 5 extend to an electric element 6 arranged in the lamp vessel In these Figures, the electric element is a pair of electrodes in an ionizable medium, for example xenon, mercury and metal halides. A glass outer envelope 8 is present around the lamp vessel. This envelope, made of quartz glass in the Figures, has a narrowed portion 9 where the outer envelope is coupled to the first neck-shaped portion 2 of the lamp vessel. A second narrowed portion 9' couples the outer envelope to the second neck-shaped portion 3. Air or inert gas may be present between the lamp vessel and the outer envelope, which may surround the lamp vessel with a clearance which is comparatively great: several millimetres, or small: one millimetre or a few tenths of a millimetre.

A metal sleeve 10 clamps around the outer envelope 8. The sleeve has a clamping zone 11 and a welding zone 12 which lies clear of glass surrounded by this welding zone. In FIG. 1, a metal fixation member 20 provided with tongues 21 welded to the sleeve 10 in the welding zone 12 thereof is fixed in a lamp cap 30.

The lamp cap 30 of insulating material is connected to the lamp vessel I by the fixation member 20 via the sleeve 10. The lamp cap has contact members 35, 36, in FIG. 1 a central pin and a ring concentric therewith, to which the current supply conductors 4, 5 are connected. In an alternative embodiment, the contact members may be clamp terminals or welding spots to which cables are fastened which issue from the lamp cap to the exterior for connection to a supply source.

The sleeve 10 narrows from the clamping zone 11 around the outer envelope 8 towards the first neck-shaped portion 2 up to the welding zone 12. The Figures clearly show that the external dimension of the sleeve 10 at the welding zone 12 is substantially smaller than that at the clamping zone 11. The fixation member may thus be dimensioned in FIG. 1 in the same way as if the outer envelope were absent. The outer envelope may be desirable, however, for example because of the temperature distribution over the lamp vessel, or for intercepting a portion of the generated radiation spectrum.

As is evident from a comparison between FIGS. 1 and 2, the clamping zone 11 of the sleeve 10 extends between the narrowed portion 9 of the outer envelope 8 and the electric element 6, in FIG. 1 at least from a location which encloses an angle $\alpha$ of 50° with the perpendicular to the outer envelope, the vertex of angle $\alpha$ lying in the centre 6' of the electric element.

Figure 3:
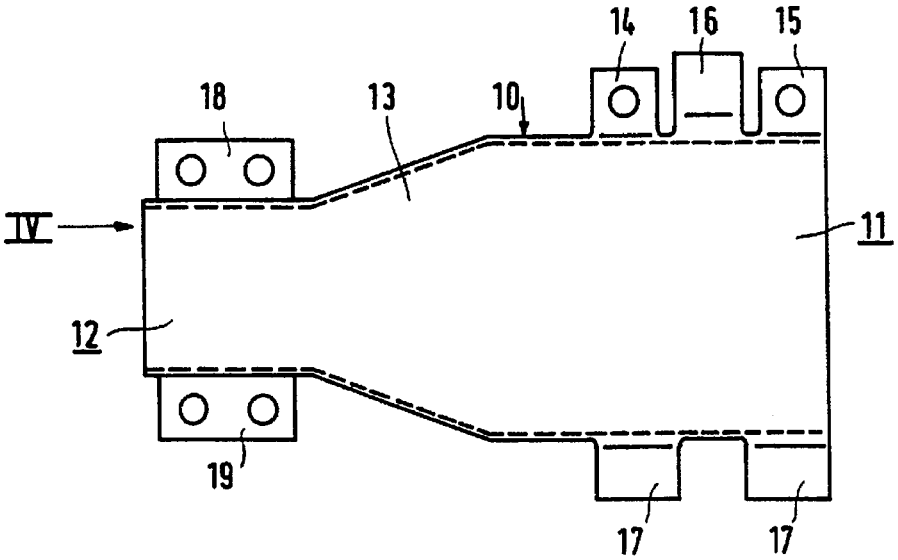
FIG. 3 is the sleeve of FIG. 1 in side elevation.
Figure 4:
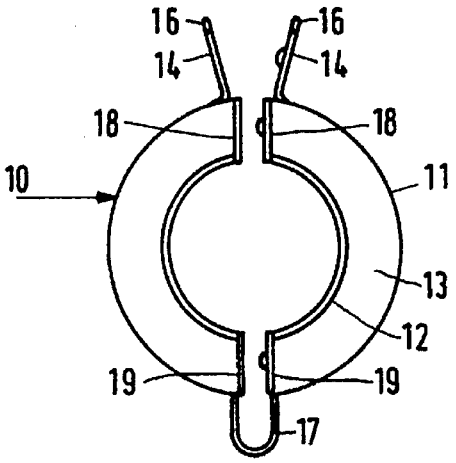
FIG. 4 shows the sleeve of FIG. 3 seen along IV.

The sleeve 10, see FIGS. 3 and 4, has two pairs of welding tags 14, 15 and closing tags 16 therebetween in the clamping zone 11. Two loops 17 in the shape of open hair-pins are present between the welding tags in the Figures. After being provided around the outer envelope 8, the clamping zone 11 is closed in that a tool causes the closing tags 16 to move together. The clamping zone is fixed in this situation in that welded joints are made in both pairs 14, 15 of welding tags. The welding zone 12 may be fixed in the dosed position by means of welds in each of the pairs 18, 19 of welding tags. Since the welding zone 12 surrounds the first neck-shaped portion 2 with clearance, little force need be exerted during making of said welds, and closing tags in this zone may be dispensed with. The clamping zone 11 and the welding zone 12 in the embodiment shown are integral with a portion 13 which narrows conically. The sleeve 10 is bent from metal plating.

The welding zone 12 of the sleeve 10 is substantially cylindrical.

Figure 5:
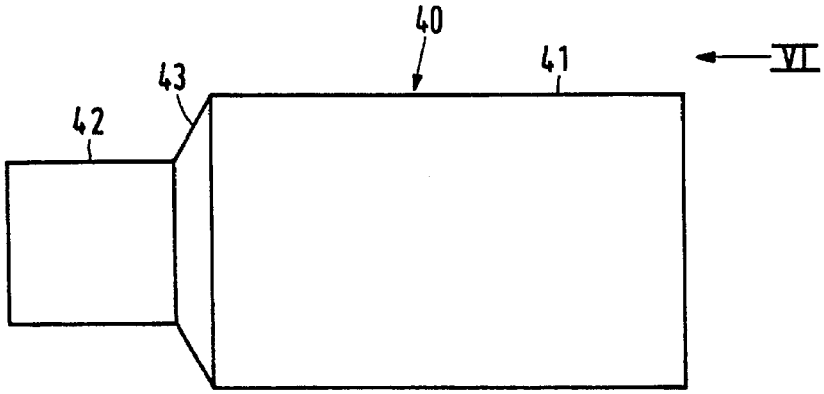
FIG. 5 is a side elevation of a second embodiment of a sleeve.
Figure 6:
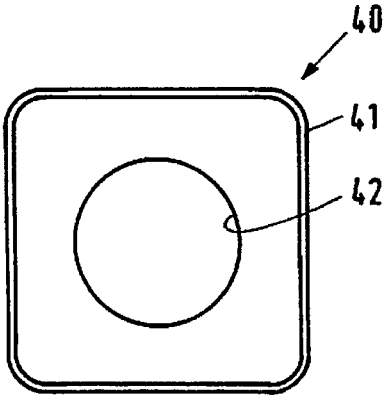
FIG. 6 shows the sleeve of FIG. 5 shown along VI.

In FIGS. 5 and 6, the sleeve 40 is tubular with an angular cross-section in the clamping zone 41. The clamping zone 41 is connected to a cylindrical welding zone 42 via a narrowing portion 43.

When the sleeve 40 is passed over the outer envelope, the clamping zone 41 is elastically deformed, the flat side faces being bent outwards. The sleeve holds the lamp vessel securely by its outer envelope.

Figure 7:
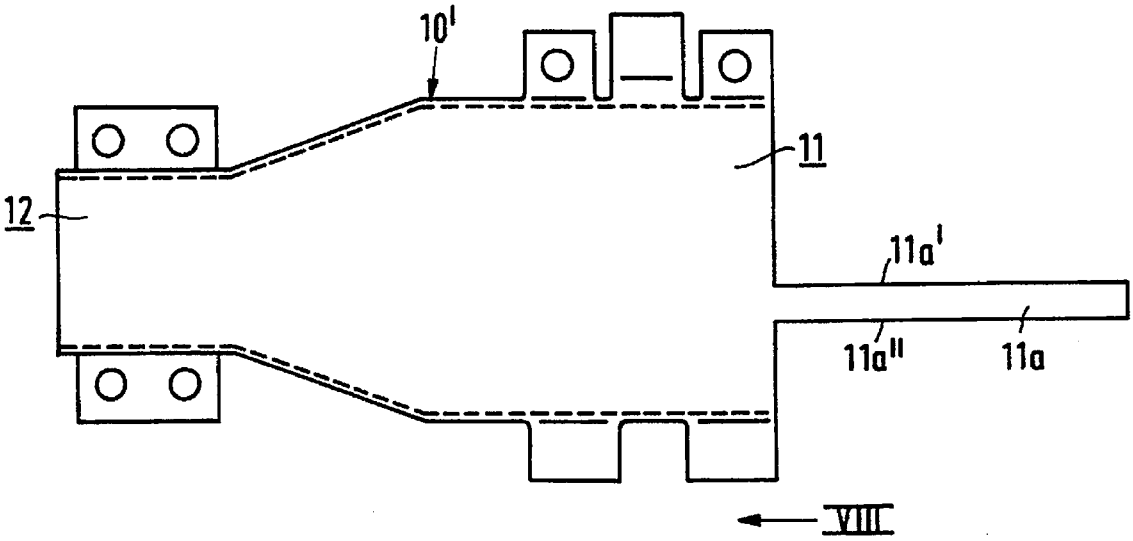
FIGS. 7 and 8 show modifications of FIGS. 3 and 4, respectively.
Figure 8:
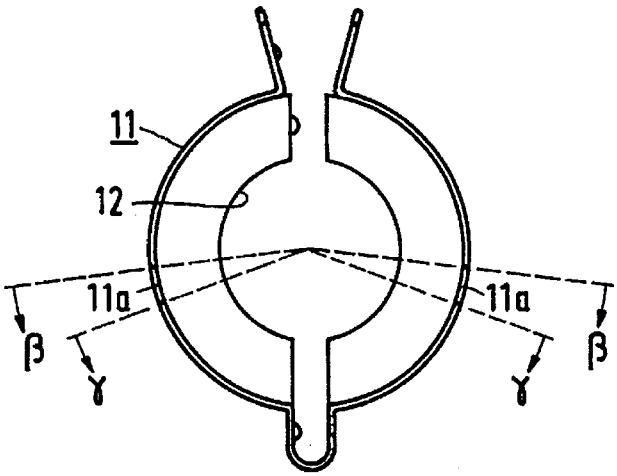

The sleeve 10' of FIGS. 7 and 8 has tongues 11*a* which extend away from the sleeve 10' and, in the mounted state, extend around an outer envelope 8 (see FIG. 1) along the electric element 6, on either side thereof. Edges 111*a'* facing away from one another enclose an angle β of approximately 165° with one another (FIG. 8), while mutually facing edges 11*a"* enclose an angle γ of 85° to 145°.

We claim:

1. A capped electric lamp comprising:

a glass lamp vessel with a first and a second neck-shaped portion in mutual opposition with seals through which respective current supply conductors are passed to an electric element arranged in the lamp vessel;

around the lamp vessel, a glass outer envelope which has a narrowed portion where the outer envelope is coupled to the first neck-shaped portion of the lamp vessel;

a metal sleeve which clamps around the outer envelope and which has a clamping zone and a welding zone which lies clear of glass surrounded by said welding zone;

a metal fixation member provided with tongues which are welded to the sleeve in the welding zone thereof;

a lamp cap of insulating material connected to the lamp vessel, in which lamp cap the fixation member is fixed and which lamp cap has contact members to which the current supply conductors are connected, characterized in that the sleeve tapers away from the clamping zone around the outer envelope towards the first neck-shaped portion up to the welding zone.

2. A capped electric lamp as claimed in claim 1, characterized in that the clamping zone of the sleeve extends between the narrowed portion of the outer envelope and the electric element.

3. A capped electric lamp as claimed in claim 2, characterized in that the welding zone of the sleeve is substantially cylindrical.

4. A capped electric lamp as claimed in claim 3, characterized in that the sleeve is bent from metal plating, and the welding zone comprises a set of pairs of mutually opposed welding tags, the welding tags of a pair being fastened to one another by welding.

5. A capped electric lamp as claimed in claim 2, characterized in that the sleeve is tubular and has an angular cross-section in the clamping zone.

6. A capped electric lamp as claimed in claim 2, characterized in that the clamping zone of the sleeve extends at least from a location enclosing an angle α of 50° with the perpendicular to the outer envelope, the vertex of angle α lying in the centre of the electric element.

7. A capped electric lamp as claimed in claim 2, characterized in that tongues extend along the electric element on either side of said electric element away from the sleeve.

8. A capped electric lamp as claimed in claim 1, characterized in that the welding zone of the sleeve is substantially cylindrical.

9. A capped electric lamp as claimed in claim 8, characterized in that the sleeve is bent from metal plating, and the welding zone comprises a set of pairs of mutually opposed welding tags, the welding tags of a pair being fastened to one another by welding.

10. A capped electric lamp as claimed in claim 1, characterized in that the sleeve is tubular and has an angular cross-section in the clamping zone.

11. A capped electric lamp as claimed in claim 1, characterized in that tongues extend along the electric element on either side of said electric element away from the sleeve.

* * * * *